US007500797B2

(12) United States Patent
Boisdon et al.

(10) Patent No.: US 7,500,797 B2
(45) Date of Patent: Mar. 10, 2009

(54) APPARATUS FOR A FLOATING PRINT HEAD AND ASSOCIATED METHOD

(75) Inventors: Olivier Boisdon, Saint-Léger-des-Bois (FR); Joël Pelletier, Saint Sylvain d'Anjou (FR); Lionel Chavarria, Moorpark, CA (US); Babak Honaryar, Orinida, CA (US); Marty Smith, Santa Rosa Valley, CA (US)

(73) Assignee: ZIH Corp., Hamilton (BM)

( * ) Notice: Subject to any disclaimer, the term of this patent is extended or adjusted under 35 U.S.C. 154(b) by 349 days.

(21) Appl. No.: 11/220,411

(22) Filed: Sep. 6, 2005

(65) Prior Publication Data

US 2006/0056896 A1 Mar. 16, 2006

Related U.S. Application Data

(60) Provisional application No. 60/607,674, filed on Sep. 7, 2004.

(51) Int. Cl.
*B41J 25/316* (2006.01)
*B41J 25/304* (2006.01)

(52) U.S. Cl. ..... 400/120.16; 347/197

(58) Field of Classification Search ..... None
See application file for complete search history.

(56) References Cited

U.S. PATENT DOCUMENTS 4,169,682 A 10/1979 Norman
4,170,422 A 10/1979 Bilek
4,685,815 A 8/1987 Baranyi et al.
4,750,880 A 6/1988 Stephenson et al.
5,694,159 A 12/1997 Kajiya et al.
2003/0146968 A1 * 8/2003 Milton ..... 347/197

FOREIGN PATENT DOCUMENTS

DE 40 05 810 A1 8/1991
JP 60105551 A * 6/1985
JP 04025482 A * 1/1992

OTHER PUBLICATIONS

PCT Notification of Transmittal of the International Search Report and the Written Opinion of The International Searching Authority, or the Declaration, mailed Jun. 14, 2006 for PCT/US2005/031919 (Filed Sep. 6, 2005).

Invitation to Pay Additional Fees including the Annex to Form PCT/ISA/206—Communication Relating to the Results of the Partial International Search from PCT/US2005/031919, Jul. 2006.

* cited by examiner

*Primary Examiner*—Daniel J Colilla
(74) *Attorney, Agent, or Firm*—Alston & Bird LLP

(57) ABSTRACT

The present invention provides a floating print head assembly and an associated method. According to one embodiment, the floating print head assembly includes a head bracket and a print head attached to the bracket such that the print head is suspended above the printing substrate. The assembly also includes an alignment mechanism disposed within the head bracket, where the alignment mechanism is operable to pivot such that the print head is capable of pivoting to apply substantially uniform print pressure across a substrate.

19 Claims, 12 Drawing Sheets

APPARATUS FOR A FLOATING PRINT HEAD AND ASSOCIATED METHOD

CROSS-REFERENCE TO RELATED APPLICATION

The present application claims priority from U.S. Provisional Application No. 60/607,674 entitled SYSTEM AND APPARATUS FOR A FLOATING PRINT HEAD AND ASSOCIATED METHOD filed Sep. 7, 2004, the contents of which are incorporated herein by reference.

BACKGROUND OF THE INVENTION

1. Field of the Invention

The present invention relates generally to a floating print head and an associated method for aligning the print head for thermal printing.

2. Description of Related Art

Thermal printers may be used to print a variety of configurations on substrates, such as cards and webs. A thermal printer typically includes a thermal print head having a row of resistors that may be activated to produce heat that is transferred to a print ribbon having thermally reactive ink or dyes and onto the substrate. One or more platen rollers is typically employed to transfer the substrate to print an array of rows to create an image or graphic, as well as to provide a support surface when the print head prints onto the substrate.

Given the increasing complexity of configurations printed on a substrate, such as images or graphics, the alignment of the print head becomes more important. It is desirable to have the line of resistors substantially aligned relative to the centerline of the platen roller to achieve a consistent print or dot line across the substrate. Because each of the multiple components that comprise the printer may have an associated tolerance, there is a greater probability of mismatching between the line of resistors and the platen as the tolerances stack up and make alignment difficult. Moreover, typical thermal printers do not allow for the print head to adjust once the print head is in a printing position, which makes realignment of the print head difficult, if not impossible.

Techniques have been developed to align the print head for thermal printing. For example, U.S. Pat. No. RE38,473 to Smolenski discloses a printer having a floating print head with alignment surfaces to position the print head. The print head is spring loaded to allow the print head to float in a vertical and horizontal direction within a lid assembly. In particular, the printer includes alignment posts having an oblique angle that corresponds to an angle on a print head alignment surface that compensates for linear and rotational misalignment. The print head includes a leaf spring, and as the print head is lowered, the print head alignment surface contacts a guide post alignment surface in the body of the printer. Because the alignment surfaces contact at oblique angles, there is a certain amount of tolerance in the approach positions between the alignment surfaces provided by the leaf spring. However, although the floating print head allows for translational and pitch alignment, the floating print head may not facilitate rolling adjustment about a longitudinal axis. As such, the Smolenski patent may not ensure that the line of resistors are both aligned relative to the centerline of the platen roller and that each of the resistors applies uniform pressure and thermal transfer across the substrate.

For these and other reasons, it would be advantageous to provide a floating print head assembly that is capable of applying uniform pressure across the substrate. Furthermore, it would be advantageous to provide a floating print head assembly that may compensate for tolerances inherent in the thermal printer assembly. It would also be advantageous to provide a floating print head assembly that is easily operated and assembled.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
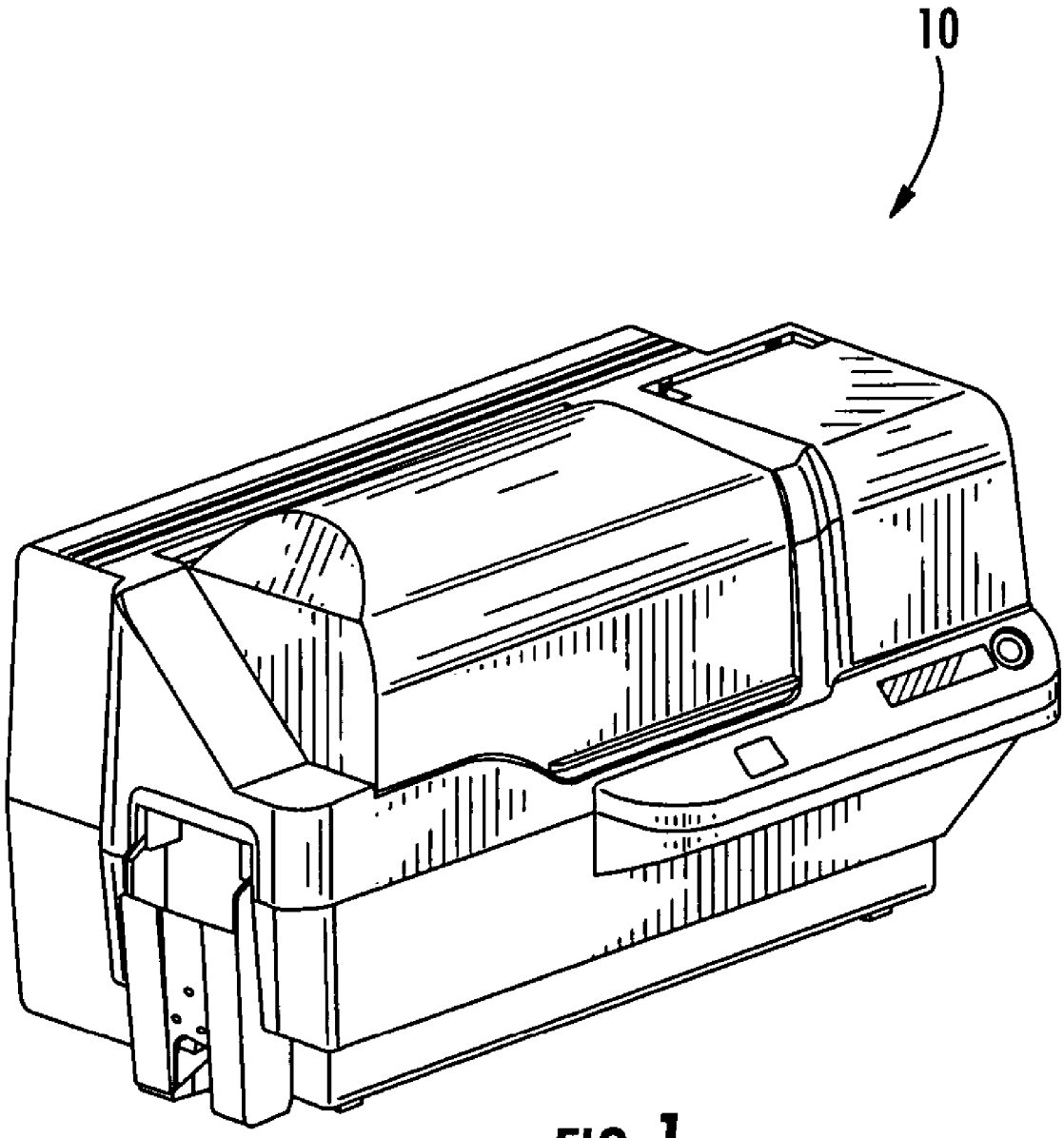
FIG. 1 is perspective view of a thermal printer, according to one embodiment of the present invention.

The present invention addresses the above needs and achieves other advantages by providing a thermal printer 10, as shown in FIG. 1, that is capable of printing substrates having uniform print quality. In particular, the thermal printer 10 includes a floating print head assembly 11 having an alignment mechanism 12 that allows a floating print head 14 to align itself and apply uniform pressure across a substrate, which results in uniform thermal transfer between the print head and a ribbon to print a variety of configurations on the substrate having a consistent print quality.

Figure 2:
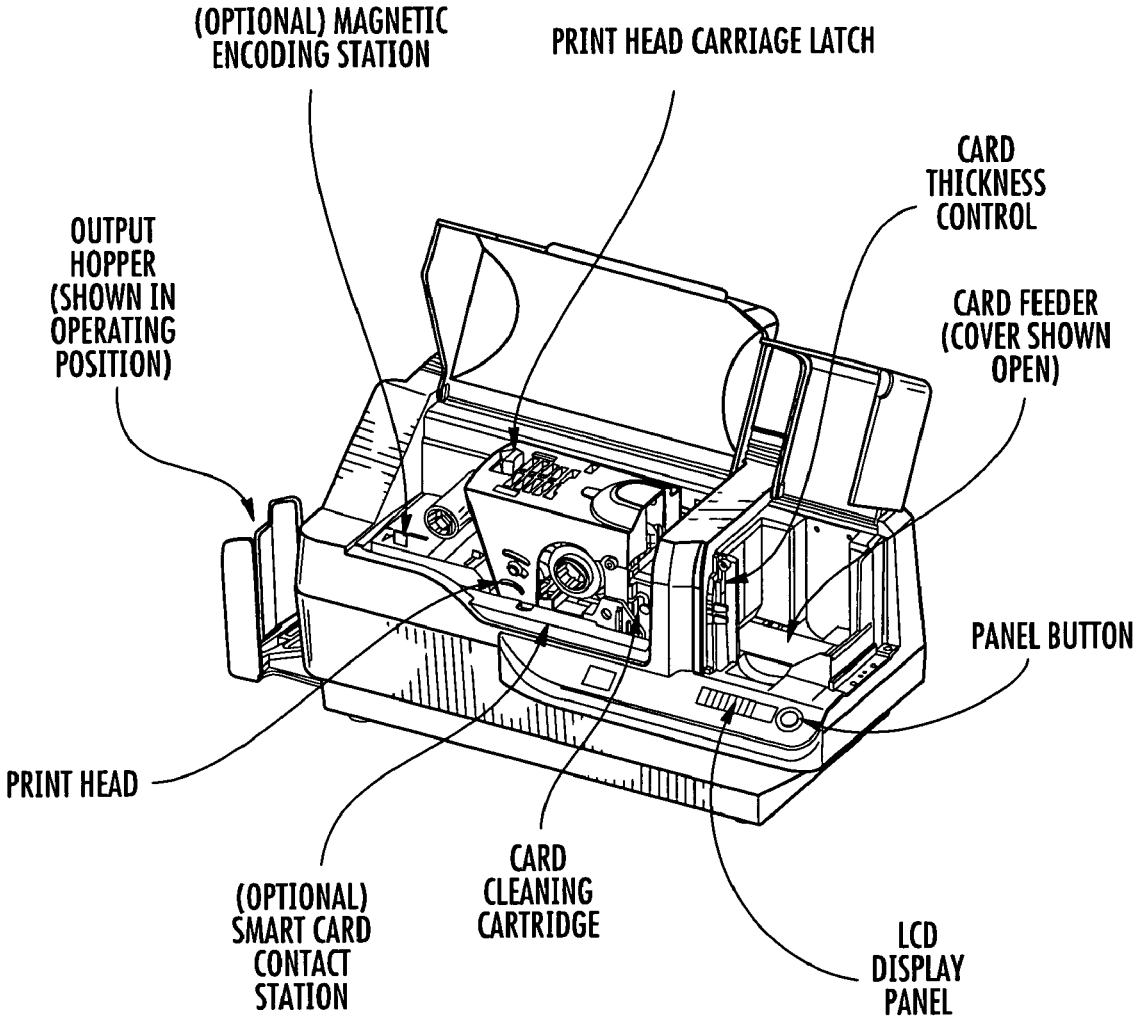
FIG. 2 is a perspective view of thermal printer shown in FIG. 1, illustrating various features of the thermal printer, according to one embodiment of the present invention.
Figure 3:
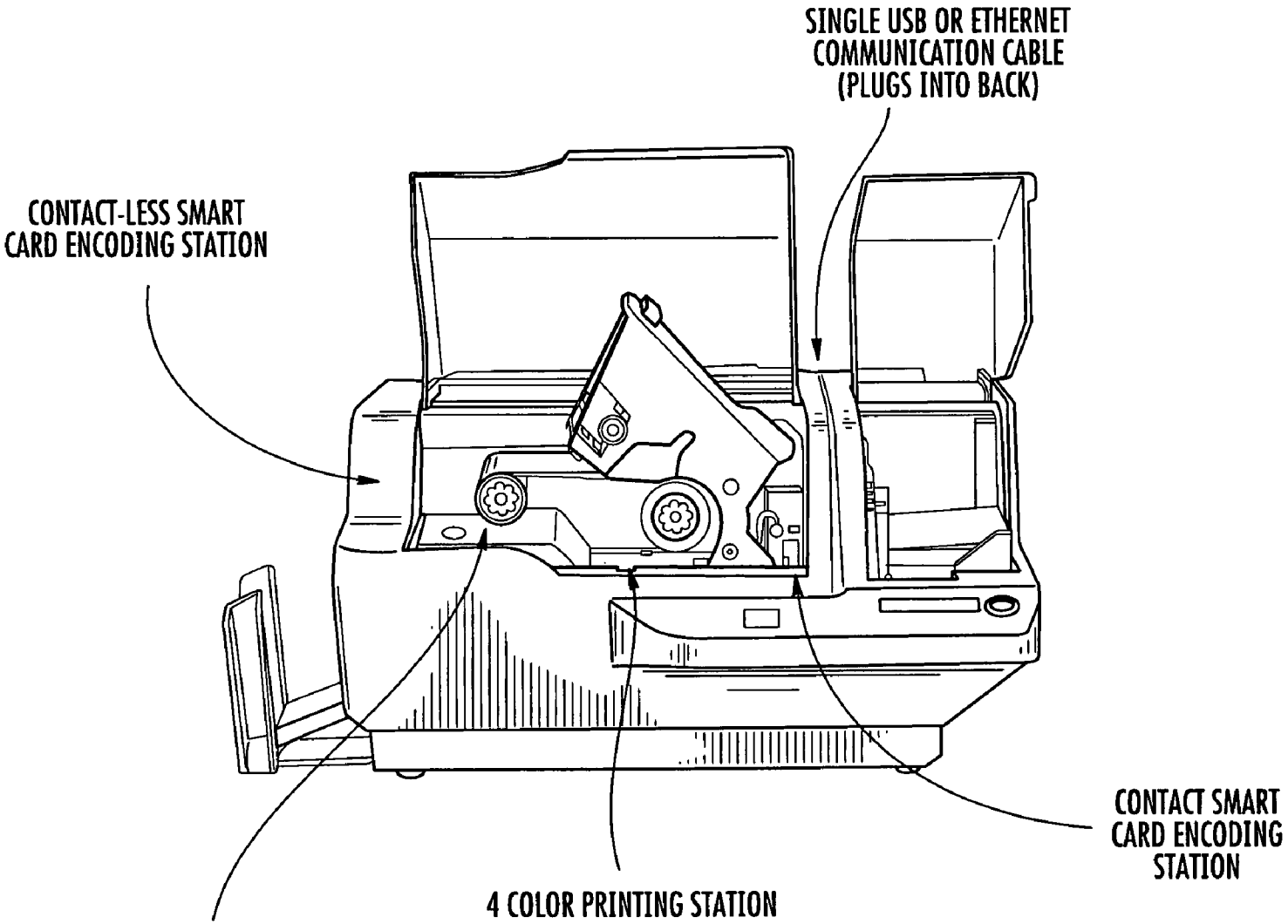
FIG. 3 is an another perspective view of the thermal printer shown in FIG. 2 illustrating the various features of the thermal printer.

Thermal printers, as known to those skilled in the art, typically include a print head having heating resistors thereon, rollers for transferring a ribbon, and a platen roller to transfer a substrate adjacent to the print head such that heat transferred from the heating resistors is transferred to the ribbon. The heated ribbon generally includes thermally reactive ink or dye that is then transferred onto the substrate. The substrates, such as smart cards, labels, identification cards, and the like, are made of a variety of materials (e.g., PVC or composite materials), could be fed individually into the thermal printer, or there may be a stack of substrates that are fed from a card feeder, such as that shown in FIGS. 2-3, to one or more platen rollers. As also depicted in FIGS. 2-3, the thermal printer may include any number of additional components, such as an encoder for encoding contactless and contact smart cards, a magnetic card stripe encoder, a smart card or magnetic stripe reader, a substrate output hopper, and/or a cleaning station having a cleaning cartridge, where individual substrates are cleaned prior to being transferred by the platen rollers to the print head. However, other mechanisms could be employed to transfer the substrate to the print head or during printing, such as belts, tracks, or carriages.

Figure 4:
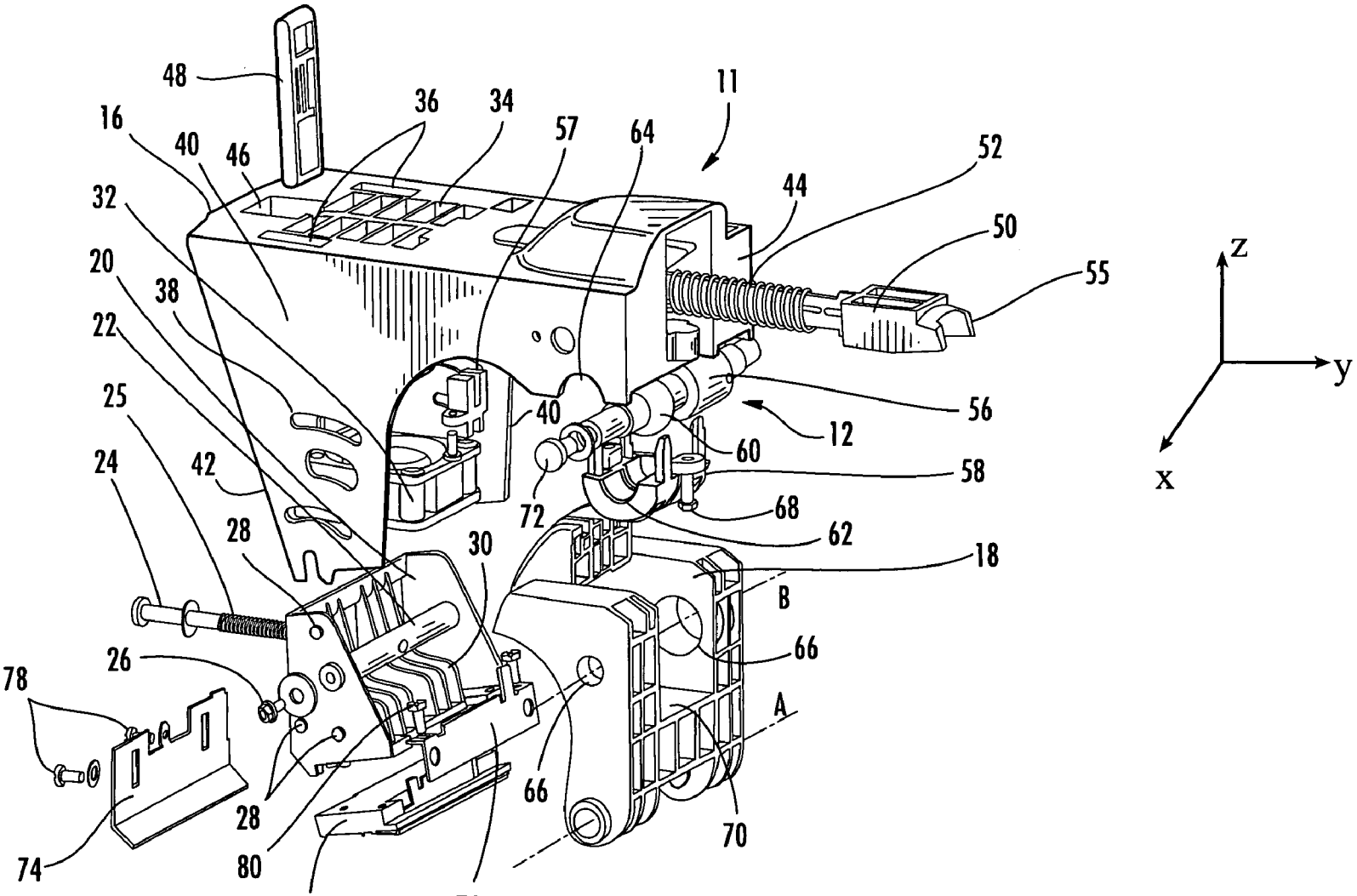
FIG. 4 is an exploded perspective view of a floating print head assembly, according to one embodiment of the present invention.

FIG. 4 illustrates a floating print head assembly 11 including an alignment mechanism 12 having a print head 14 attached to a head bracket 16. The floating print head assembly 11 is pivotally attached to the thermal printer 10 through an axis A defined in a pivot bracket through a pivot bracket shaft. The head bracket 16 and print head 14 are pivotally connected to the pivot bracket 18 at axis B, where the head bracket and print head may rotate about multiple axes (e.g., pitch, roll, and yaw) defined by the alignment mechanism 12.

The floating print head assembly 11 includes a print head support 20, where the print head 14 may attach thereto. The head bracket 16 defines a cavity that allows the print head support 20 to fit therein when assembled. The print head support 20 includes a shaft 22 and an adjustment screw 24 and adjustment spring 25 that may engage a threaded portion in the shaft substantially perpendicular to the longitudinal axis of the shaft. The print head support 20 also includes a screw 26 that may engage an end of the shaft 22 along a longitudinal axis of the shaft. Each lateral edge of the print head support 20 further includes one or more detents 28 extending outwardly from the print head support.

The print head support 20 is typically a heat sink, such as die cast aluminum, that is used to conduct heat away from the print head 14. To transfer excessive heat away from the print head 14, the print head support 20 may include one or more fins 30. Typically, the floating print head assembly 11 includes a fan 32, such as a whisper fan or similar electric fan, that aids in drawing heat away from the print head 14. As shown in FIG. 4, the fan 32 is mounted within the head bracket 16 proximate to a grate 34 to draw heat away from the print head 14 and through the head bracket. The grate 34 is preferably defined in the head bracket 16 so that heat may dissipate through openings defined in the grate and away from the floating print head assembly 11. In FIG. 4, the grate 34 is shown defined in a top portion of the head bracket 16, although the grate could be defined in any convenient location on the head bracket. To provide power to generate heat in the print head 14 and operate the fan 32, wiring 33 and associated conduit is provided, as shown in FIG. 7.

Figure 7:
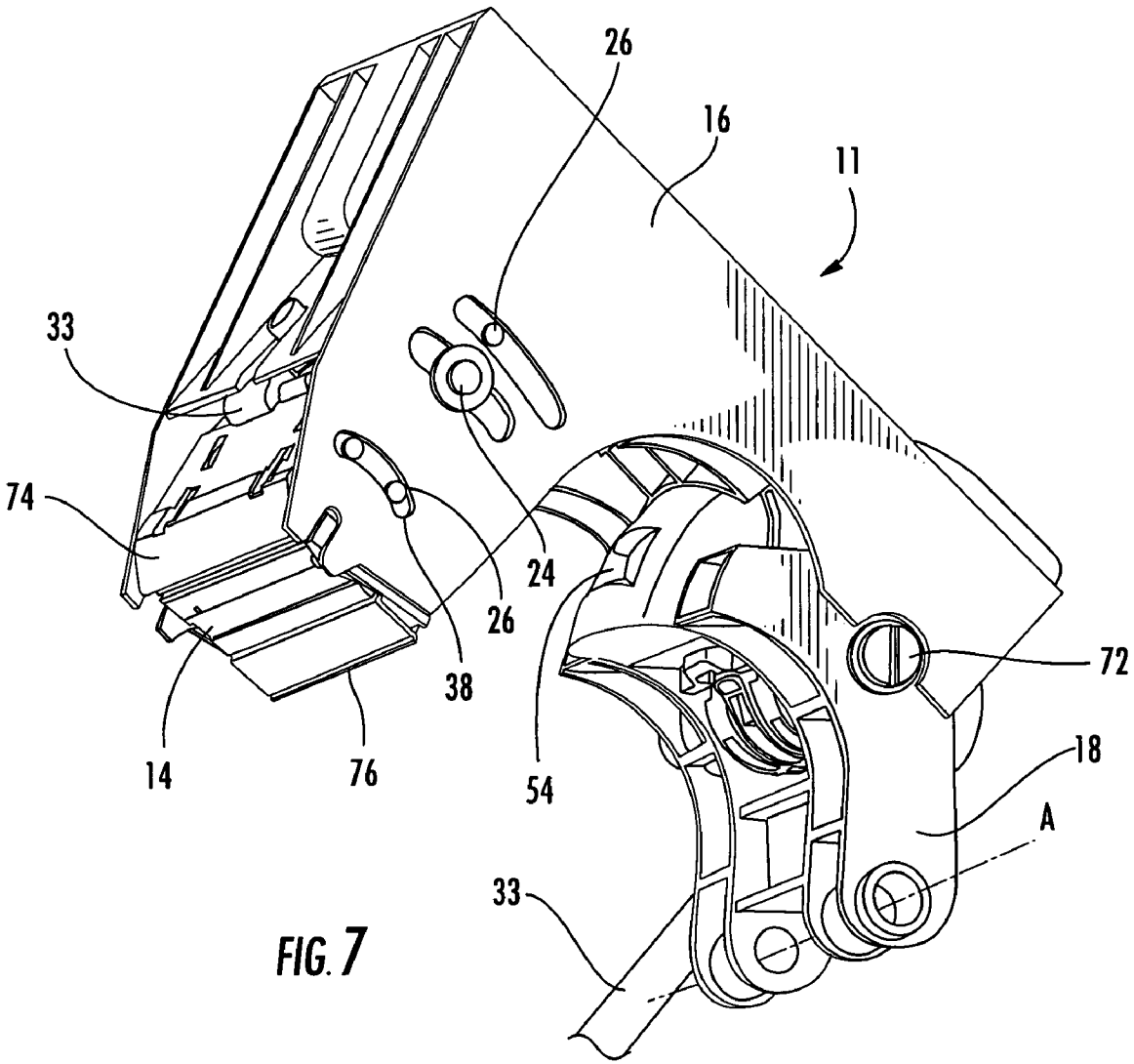
FIG. 7 is a side elevation view of the floating print head assembly shown in FIG. 4 illustrating the floating print head assembly fully assembled and in an open, non-printing position.

A peel bar 74 and a film bar 76 are attached to the print head support 20, as shown in FIGS. 4 and 7. The peel bar 74 is attached to the print head support 20 with screws 78, while the film bar 76 is attached to the print head support with screws 80. The peel bar 74 is used to peel the ribbon off of a substrate and control noise when removing the ribbon, while the film bar 76 creates a smooth contact for the ribbon as a first end of the ribbon extends along the film bar and print head 14 and along the peel bar to a second end of the ribbon. Moreover, the film bar 76 may function as an optically reflective surface for ribbon color LED's for identifying different panel colors for a full color ribbon. The peel bar 74 and film bar 76 are typically sheet metal or similar material to provide a smooth contact surface for the ribbon.

The adjustment screw 24 is utilized to adjust the print head support 20 and print head 14 about a x-axis (i.e., pitch). The adjustment screw 24 is typically adjusted to a predetermined position based on a manufacturer's specifications, such that further adjustments are not usually required once initially set. The adjustment screw 24 may be rotated to adjust the print head 14 angle to ensure that a line of resistors on the print head align with a platen roller positioned adjacent to a ribbon and a substrate. Thus, the dot line produced by the print head 14 is not fixed and may also be adjusted to achieve various degrees of pressure across the substrate by adjusting the position of the print head. The print head 14 may be adjusted linearly and/or about a z-axis (i.e., yaw) with a pair of screws (not shown), where a screw driver or other adjustment device may be inserted through slots 36 defined in the head bracket 16 to access the screws extending through the print head support 20 and into the print head 14. Once the screws are loosened, the print head 14 may be adjusted linearly and/or about a z-axis and the screws retightened to secure the print head in a desired position.

The head bracket 16 includes arcuate slots 38 that mate with the screw 26 and detents 28 of the print head support 20, as illustrated in FIG. 7. In particular, the detents 28 engage the upper and lower arcuate slots 38, while the screw 26 engages an arcuate slot located between the upper and lower slots. The screw 26 and detents 28 engage the arcuate slots 38 such that the print head support 20 may pivot about an x-axis (i.e., pitch) along the arcuate slots. As such, the arcuate slots 38 restrict the degree of pitch that the print head support 20 may be rotated. The arcuate slots 38 are defined in respective lateral edges 40 of the head bracket 16 such that the print head support 20 may engage each of the lateral edges. In general, a position along the midpoint of the arcuate slots 38 corresponds to a centerline of a platen roller positioned adjacent to the print head 14.

Figure 8:
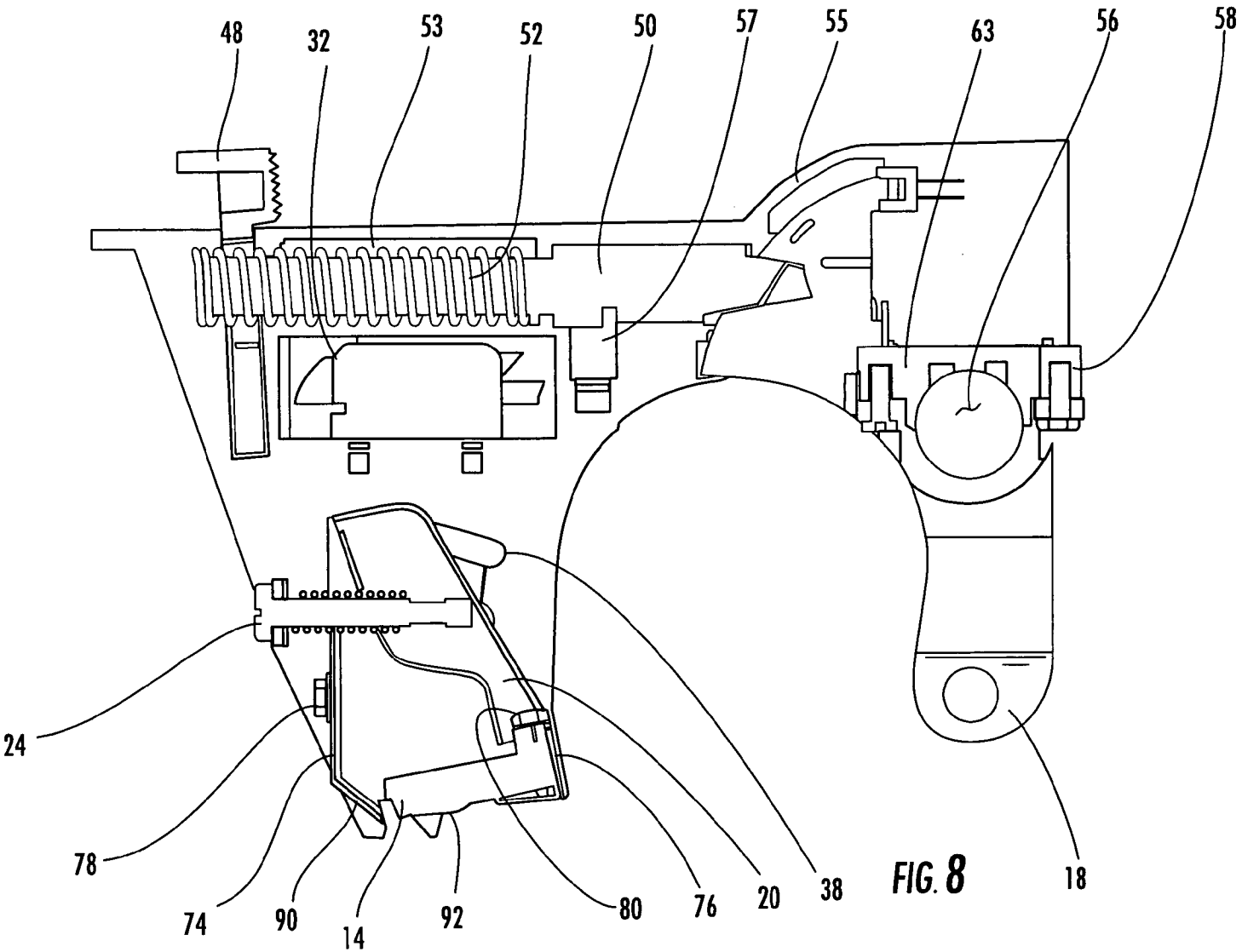
FIG. 8 is a cross-sectional plan view of the floating print head assembly shown in FIG. 4.

The head bracket 16 also defines a latch slot 46, where a latch button 48 is sized and configured to insert through the latch slot. The latch button 48 is operatively connected to a latch 50 such that the latch button may be depressed to activate the latch. Thus, a distal edge 44 of the head bracket 16 includes an aperture that is sized and configured to allow the latch 50 to extend therethrough and engage the pivot bracket 18, as depicted in FIG. 8. The latch 50 includes a latch spring 52 that forces the latch to engage the pivot bracket, and as the latch button 48 is depressed, the latch spring is biased and the latch moved out of engagement with the pivot bracket 18. The head bracket 16 may include a spring aperture 53 sized and configured for the latch spring 52, such that when the latch spring relaxes and extends within the spring aperture to a predetermined position and spring force, the latch 50 is forced to engage the pivot bracket 18.

Figure 5:
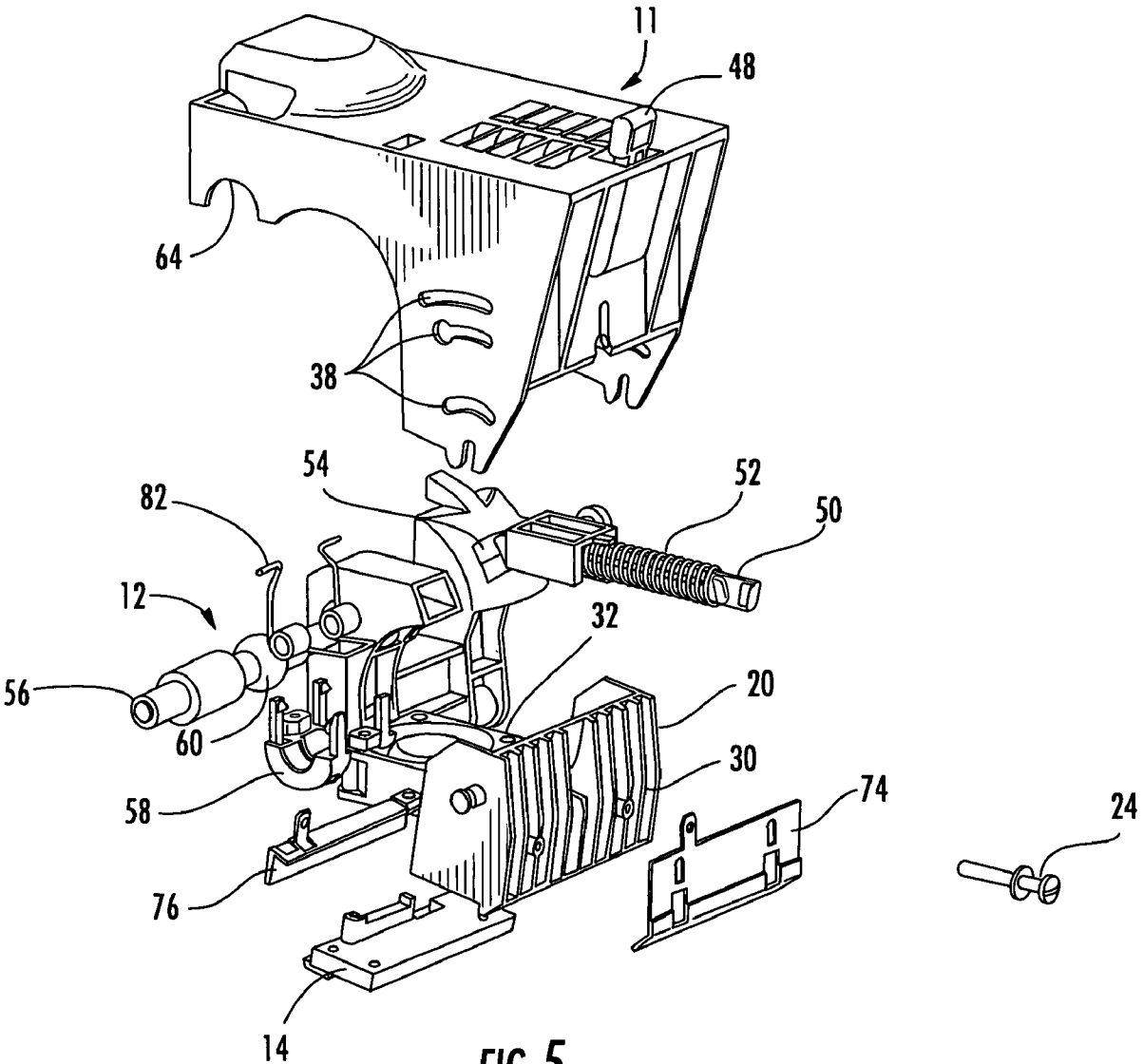
FIG. 5 is another exploded perspective view of a floating print head assembly, according to an additional embodiment of the present invention.

FIG. 5 illustrates that the pivot bracket 18 includes a pivot slot 54 that allows an engaging end 55 of the latch 50 to extend therein. The engaging end 55 is preferably in a fork-like configuration to engage the pivot slot 54, although the engaging end could be any desired configuration that is capable of engaging the pivot slot in alternative embodiments of the present invention. The pivot slot 54 is preferably sized and configured to also allow the engaging end 55 of the latch 50 to pivot therein such that the pivot slot defines an arcuate curvature and is larger than the relative width of the engaging end. It is understood that the pivot slot 54 could be various configurations for facilitating engagement of the engaging end 55 and allowing the engaging end to pivot therein. For example, the pivot slot 54 could include a bearing that receives the engaging end 55 to allow rotation about a roll axis.

The floating print head assembly 11 also includes a sensor 57, such as an infrared sensor, that may be used to detect when the latch 50 has slid through the head bracket 16 to an unlatched or disengaged position. In one embodiment, the sensor 57 is attached to the head bracket 16 such that the latch 50 may slide through a notch defined in the sensor. When the latch 50 is disengaged with the pivot bracket 18, the sensor 57 detects when the latch has moved beyond a designated position and sends a signal to the thermal printer 10 to not print since the print head 14 is in a non-printing position.

The floating print assembly 11 includes an alignment mechanism 12 that generally includes a ball joint shaft 56 and a ball joint cap 58. The ball joint shaft 56 defines various diameters along the axis of the shaft and includes a ball 60 positioned approximately about the midpoint of the shaft, although the ball could be positioned at various locations along the ball joint shaft. The ball 60 is sized and configured to fit within a socket 62 defined in the ball joint cap 58 such that the head bracket 16 and ball joint cap 58 are capable of pivoting about a x, y, and z-axis. The ball 60 could be integral with, or separately attached to, the ball joint shaft 56. As shown in FIG. 8, the head bracket 16 includes a similar socket 63 that mates with the socket 62 and the ball joint cap 58, which allows the head bracket and ball joint cap to pivot about the ball 60 between each socket. Generally, the diameter of the sockets 62, 63 are substantially similar to that of the ball 60 to permit rotation of the head bracket 16 and ball joint cap 58 thereabout. It is understood that the ball joint shaft 56 could include other suitable pivot members for facilitating rotation, such as a roller or bearing that mates with the head bracket 16 and/or ball joint cap 58 and allows rotation about a roll axis. Thus, the head bracket 16 and ball joint cap 58 could be any desired configuration for cooperating with the ball joint shaft 56 to facilitate rotation about one or more axes.

The head bracket 16 includes a slot 64 defined in each lateral edge 40, where the slots are preferably arcuate to correspond to a radius of the ball joint shaft 56, such that the ball joint shaft may fit within the slots. The ball joint shaft 56 extends through openings 66 defined in the pivot bracket 18. As shown in FIG. 4, one opening 66 defined in the pivot bracket 18 is smaller in diameter than a second opening. The smaller diameter portion of the ball joint shaft 56 is sized and configured to fit within the smaller opening 66 defined in the pivot bracket 18, while the larger diameter portion of the ball joint shaft fits within the larger diameter opening. As such, the ball joint shaft 56 fits within the openings 66 defined in the pivot bracket 18 and the slots 64 defined in the head bracket 16 such that the ball joint shaft is secured therein, while the head bracket 16 and ball joint cap 58 may rotate about a x, y, and/or z axis as the sockets 62 and 63 pivot about the ball 60. It is understood that the slots 64 and openings 66 could be any size and configuration in additional embodiments of the present invention. For example, there could be a single opening 66 such that the ball joint shaft 56 extends completely within the opening, and the openings could be separate but the same diameter.

Although the alignment mechanism 12 is shown to extend along axis B, it is understood that the alignment mechanism could be positioned at various locations. For example, the alignment mechanism 12 could extend along axis A or along shaft 22. Thus, the alignment mechanism 12 could be located at various locations to achieve a desired amount of rotation about one or more axes to allow the print head 14 to apply uniform pressure on the substrate during printing.

When the ball joint shaft 56 is inserted within the openings 66 defined in the pivot bracket 18, the ball joint cap 58 is assembled to the head bracket 16 with a pair of screws 68. The pivot bracket 18 includes a cavity 70 such that the ball joint cap 58 may fit within the cavity and attach to the head bracket. A screw 72 is inserted within the smaller opening 66 and into the end of the ball joint shaft 56 to prevent the ball joint shaft from sliding out of the opening or out of position, and is preferably fastened flush with the pivot bracket 18.

Figure 12A:
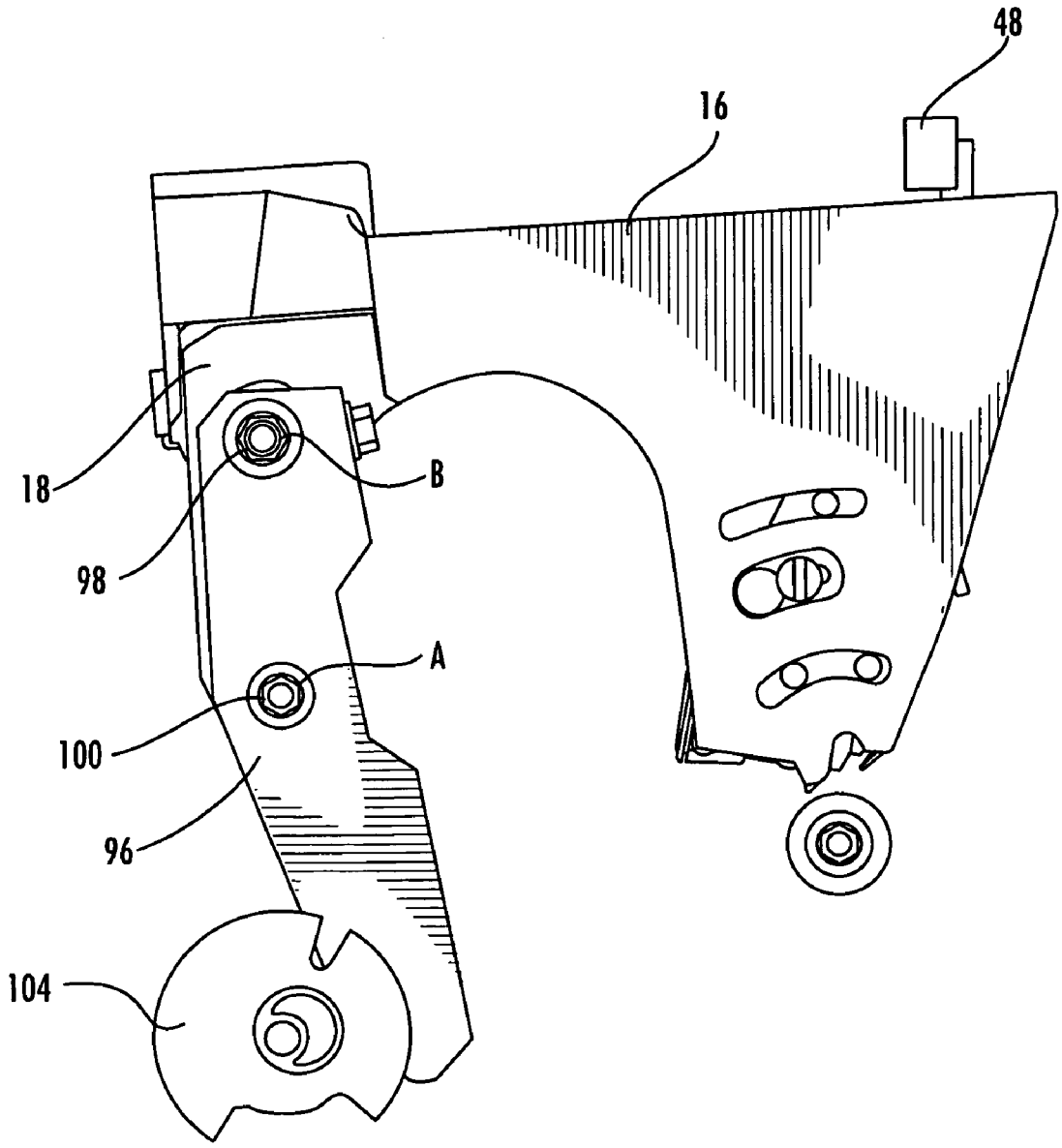
FIG. 12A is a side elevation view illustrating a floating print head assembly and a lever for applying a print head force to the floating print head assembly, according to another embodiment of the present invention.
Figure 12B:
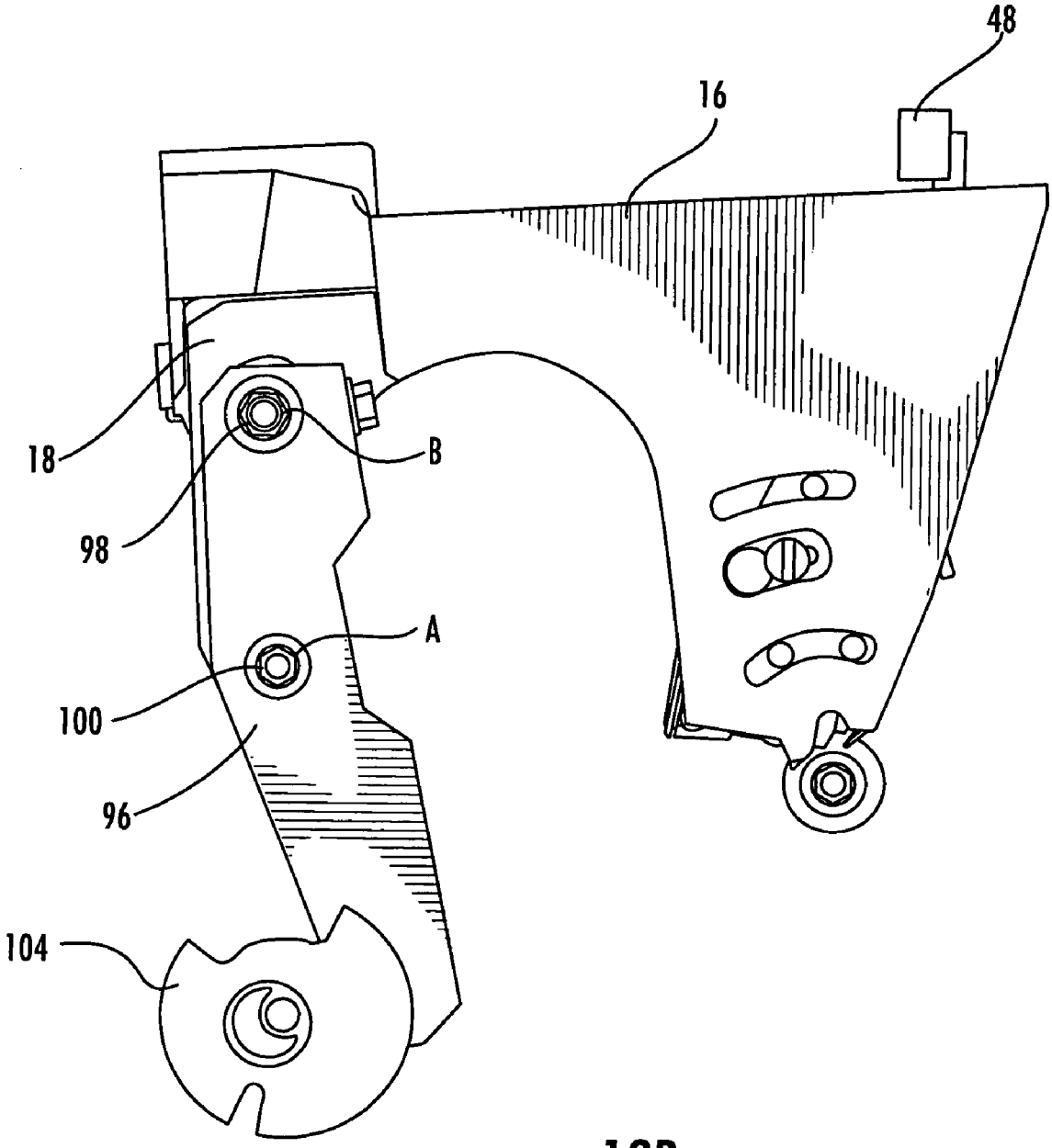
FIG. 12B is a side elevation view of the floating print assembly of FIG. 12A in a printing position.

As shown in FIGS. 12A-12B, a lever 96 may be coupled to the opposite end of the ball joint shaft 56 that includes the screw 72. The end of the ball joint shaft 56 extends through the larger diameter opening 66 such that it may engage the lever 96. Typically, the lever 96 is oriented along the z-axis and could be a rod, longitudinal plate, or similar structure, having at least two holes defined therein. An upper hole 98 is provided in the lever to couple to the ball joint shaft 56 that extends through the larger diameter opening 66 and along axis B. A middle hole 100 is provided in the lever to couple to the pivot bracket shaft through axis A. Any suitable drive or mechanism, such as a cam 104, could engage the lever to apply print head pressure through axis B, as well as cause rotation of the floating print head assembly 11 about axis A. In addition, a third or lower hole could be provided in the lever 96 to connect to the drive mechanism, which could be used to provide the print head force, as well as the rotate the assembly.

Thus, the cooperation of the ball joint shaft 56 and ball joint cap 58 of the alignment mechanism 12 permit the head bracket 16 and print head support 20 to rotate, which causes the print head 14 to rotate. Specifically, the head bracket 16, the print head support 20, and print head 14 are capable of collectively rotating about a x-axis (i.e., pitch), as well as rotating about a y-axis (i.e., roll) and about a z-axis (i.e. yaw). Preferably, the print head 14 is fixed in pitch and yaw while in a printing position, but the print head may adjust its roll while in a printing position by gimbaling or floating with the alignment mechanism 12. The slots 64 defined in the head bracket 16 prevent the head bracket 16 from pivoting about a y-axis more than a predetermined angle, such as between 5 and 10 degrees in one embodiment of the present invention, as the print head bracket 16 is only capable of being pivoted until the ball joint shaft contacts an upper portion of the slot on either of the lateral edges 40 of the head bracket.

Figure 6:
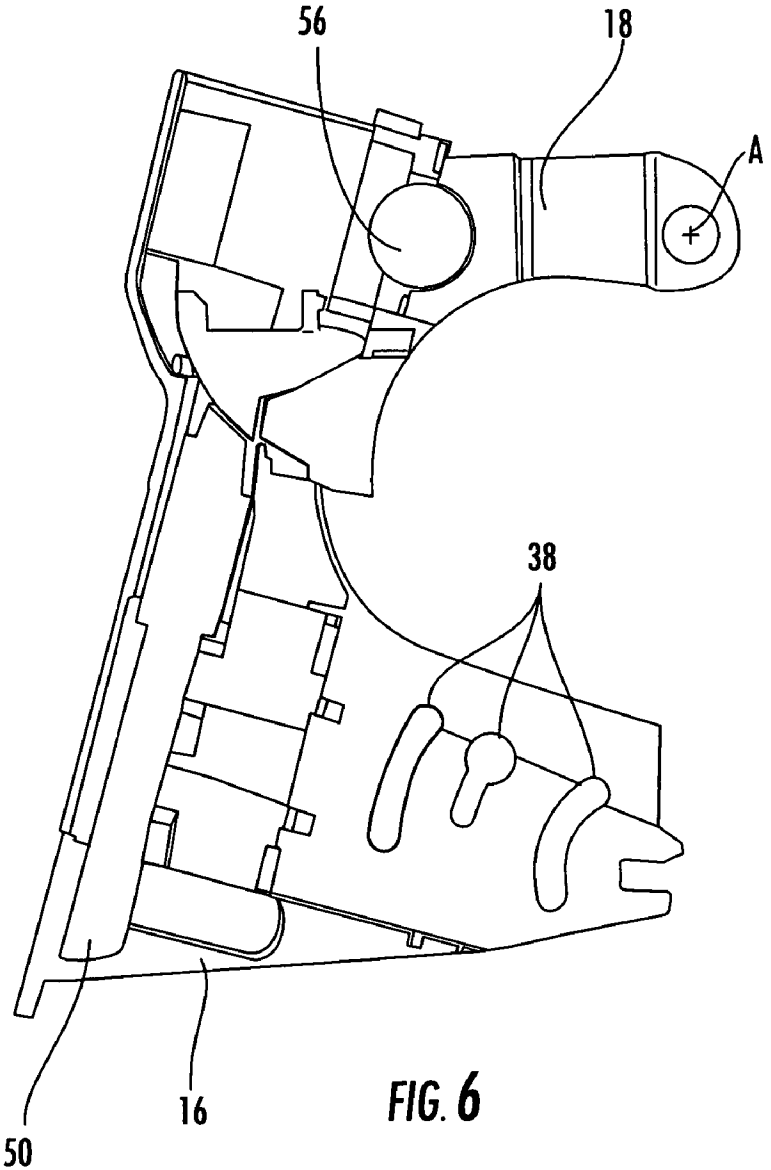
FIG. 6 is a side elevation view of the floating print head assembly shown in FIG. 5 illustrating the floating print head assembly partially assembled and in a partially opened position.

FIGS. 5 and 6 illustrate an additional embodiment of the present invention. The floating print head assembly 11 demonstrates that there may be various modifications in the design of the assembly and still be within the scope of the present invention. Thus, the size and configuration of various components of the floating print head assembly 11 could be modified to accommodate any number of thermal printers 10. For example, as depicted in FIG. 5, the print head support 20 may be any desired size or configuration, and the head bracket 16 could be modified as well, such as the size and configuration of the arcuate slots 38. Moreover, the ball joint shaft 56 could have various diameters or a single diameter along the shaft, as well as any diameter for the ball 60. The ball joint shaft 56 could be a series of components that are assembled to form the shaft, or the shaft could be manufactured from a single piece of material. Furthermore, the floating print head assembly 11 could include a spring 82 to apply pressure to the print head 14, and/or a spring could be positioned within the pivot bracket 18 to aid in pivoting the head bracket 16 and print head 14 between a printing position and a non-printing position.

FIGS. 7 and 8 illustrate the floating print head assembly 11 with each of its components assembled. To assemble the alignment mechanism 12 within the floating print head assembly 11, generally the latch button 48, latch 50, and latch spring 52 will first be positioned in the head bracket 16. The ball joint shaft 56 may then be inserted within the openings 66 defined in the pivot bracket 18 with the smaller diameter portion of the shaft inserted first. The ball joint shaft 56 will typically include a raised edge or similar structure on the diameter of the ball joint shaft that restricts the movement of the smaller diameter portion from traveling through the openings 66 past a designated position. A screw 72 is then inserted into one end of the ball joint shaft 56 to ensure the ball joint shaft does not slide out of the opening 66 or become misaligned. The ball joint cap 58 is then secured to the head bracket 16 with screws 68. The fan 32 and print head support 20 with the print head 14 attached thereto may then be assembled within the head bracket 16.

Figure 10A:
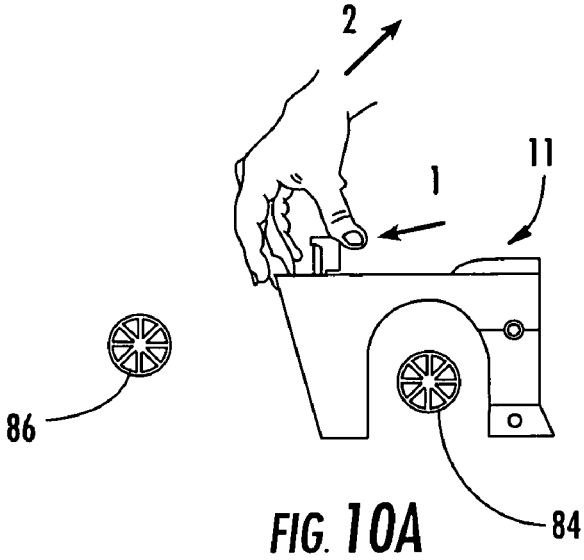
FIG. 10A is a side elevation view of the floating print head assembly in a printing position, according to one embodiment of the present invention.

FIG. 7 depicts the floating print head assembly 11 in a non-printing position, where the head bracket 16 is pivoted about the ball joint shaft 56 upwardly to a predetermined position. FIG. 8 shows the floating print head assembly 11 in a printing position, where the head bracket 16 is in a lowered position. When lowered, the curvature of the head bracket 16 and pivot bracket 18 cooperate to define an opening for a first ribbon spool 84 (see FIG. 10A showing the spool positioned within the opening). A ribbon 88 extends from the first ribbon spool 84, along the film bar 76, under the print head 14, along a portion of the peel bar 74 and to a second ribbon spool 86.

FIGS. 11A-D generally depict the location of the ribbon spools 84, 86 and ribbon 88 in relation to the floating print head assembly 11, while FIG. 8 shows a more detailed view of the components that may be in intimate contact with the ribbon. In particular, FIG. 8 illustrates that the film bar 76 provides a surface for the ribbon 88 to contact as the ribbon extends from the first ribbon spool and below the print head 14. The film bar 76 typically includes a smooth radius to allow the ribbon to glide along the film bar as the ribbon spools 84, 86 are rotated. Similarly, the peel bar 74 has a slightly angled surface 90 that provides a smooth transition for the ribbon 88 as the ribbon extends along the print head 14 and to the second ribbon spool 86. FIG. 8 also demonstrates that the print head 14 includes a glazed curvature surface that corresponds to a row of heated resistors 92. The resistors 92 generate heat and transfer the heat to the ribbon 88 during printing to generate a printed dot line across the substrate.

Figure 9A:
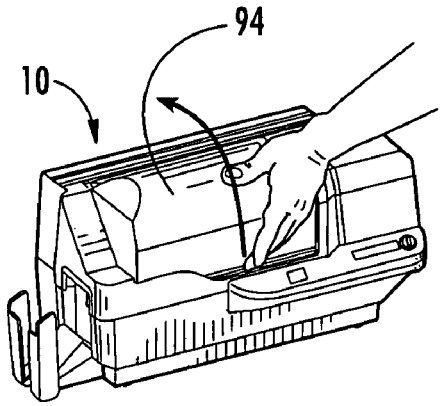
FIG. 9A is a perspective view of a user opening a cover of the thermal printer shown in FIG. 1, according to one embodiment of the present invention.
Figure 9B:
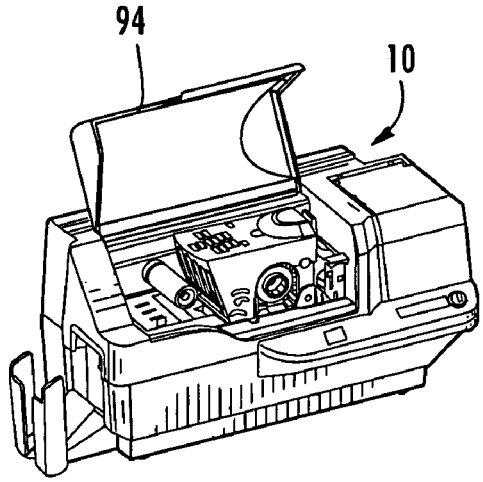
FIG. 9B is a perspective view of the thermal printer after the user has opened the cover, according to one embodiment of the present invention.
Figure 10B:
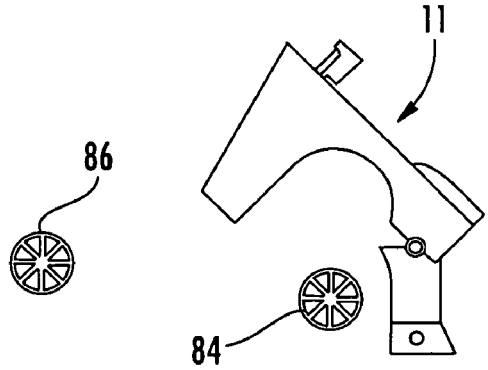
FIG. 10B is a side elevation view of the floating print head assembly in a non-printing position, according to one embodiment of the present invention.
Figure 11A:
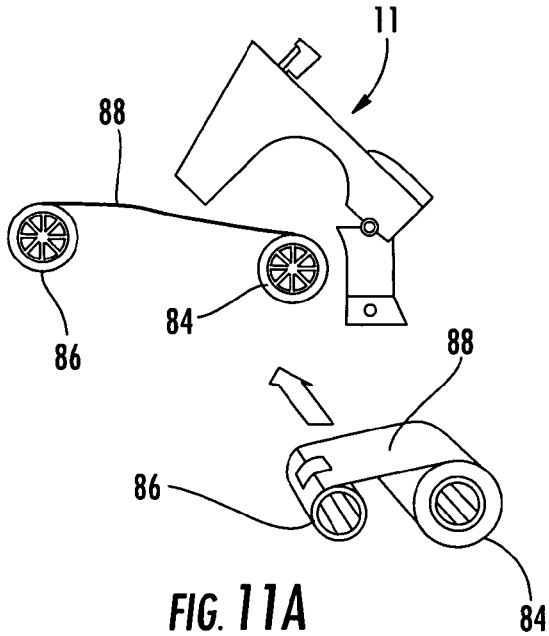
FIG. 11A is a side elevation view of the floating print head assembly in an open position and a perspective view of a pair of rollers having a ribbon disposed thereon, according to one embodiment of the present invention.
Figure 11B:
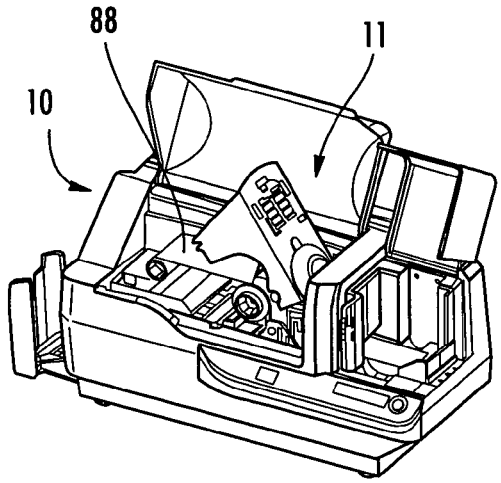
FIG. 11B is a perspective view of a thermal printer with the floating print head assembly in an open position and the rollers and ribbon installed within the thermal printer, according to one embodiment of the present invention.
Figure 11C:
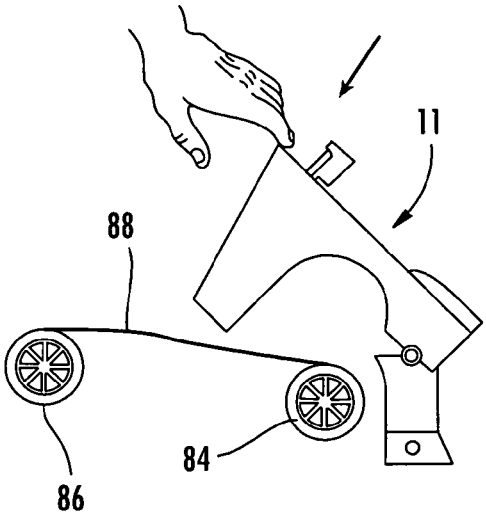
FIG. 11C is a side elevation view illustrating a user moving the floating print head assembly from an open position to a printing position, according to one embodiment of the present invention.
Figure 11D:
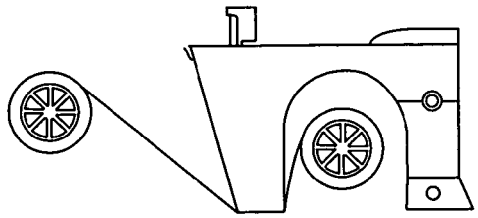
FIG. 11D is a side elevation view showing the floating print head assembly of FIG. 11C in a printing position, according to one embodiment of the present invention.

Once assembled, the operation of the floating print head assembly 11 is predominately self-sufficient, such that a minimal amount of user intervention is required to ensure that the print head 14 is aligned and producing uniform pressure across the ribbon 88 and to a substrate. To move the floating print head assembly 11 from a printing position to a non-printing position, a cover 94 on the thermal printer 10 is raised by a user, as shown in FIGS. 9A-B. FIGS. 10A-B illustrate that as the latch button 48 is moved forwardly (as shown by arrow 1), the floating print head assembly 11 may be raised from a printing position to a non-printing position (as shown by arrow 2) either manually by the user or automatically, such as with a spring. Typically, once the latch button 48 is depressed the floating print head assembly 11 is locked in a non-printing position at a predetermined angle, such as 45 degrees. In the non-printing position, the ribbon spools 84, 86 and ribbon 88 may be replaced, the print head 14 may be manually inspected and/or cleaned, and/or the positioning of the floating print head assembly 11 may be adjusted.

FIGS. 11A-D illustrate the position of the ribbon 88 within the thermal printer 10, and to move the floating print head assembly 11 from a non-printing position to a printing position, the user simply moves the floating print head assembly downwardly (as shown by the arrow in FIG. 11C) until locked in the printing position. When the floating print head assembly 11 is lowered, the engaging end 55 of the latch 50 will be forced to engage within the pivot slot 54 to lock the assembly in the printing position. Typically, the engaging end 55 of the latch 50 is forced along the curvature of the pivot bracket 18, and once the engaging end enters the pivot slot 54, the spring biases the latch into engagement with the pivot bracket.

Once the floating print head assembly 11 is lowered to a printing position, the print head 14 is operational and may print onto a substrate. In the printing position, the print head 14 may align itself to apply uniform pressure across the substrate as the head bracket 16 and ball joint cap 58 rotate to adjust the roll of the print head. There may be a slight movement in the pitch and yaw of the print head 14 as the roll of the print head is adjusted or the print head moves over an uneven surface, although the roll of the print head will be predominately self-adjusted during printing. Thus, the print head 14 may align itself when settling in on the ribbon 88 and substrate. As mentioned previously, the latch 50 includes an engaging end 55 that engages a pivot slot 54, where the pivot slot defines a curvature that corresponds to the rotation about the ball joint shaft 56 about a y-axis (i.e., roll). In addition, the pivot slot 54 is slightly larger in dimension than the engaging end 55 of the latch 50 (see FIG. 5) such that as the alignment mechanism 12 pivots about a y-axis, the head bracket 16 and print head support 20 may also pivot about the y-axis.

To create an image or similar configuration on a substrate, the substrate is preferably indexed prior to printing onto the substrate. Specifically, a ribbon 88 typically includes panels of colors arranged in series along the ribbon. Thus, once the substrate and print head 14 are in a starting printing position, the substrate will be moved by one or more platen rollers to generate a plurality of dot lines along the substrate. When additional colors are added to the substrate, print head 14 will be pivoted slightly off of the substrate about the pivot bracket shaft and axis A such that the substrate may be indexed back to the starting printing position. The ribbon 88 will be indexed to a desired color and positioned adjacent to the substrate, and the printing process is then repeated with additional colors on the ribbon.

Typically, once the substrate and ribbon 88 are properly positioned, the print head 14 is lowered to the printing position and then cycled out of the printing position one time about the pivot bracket shaft to allow the print head to readjust or reset itself, although the print head could be cycled any number of times or none at all. For instance, a device, such as a cam 104, is used in conjunction with a lever 96 to pivot the floating print head assembly 11 slightly upwards away from the ribbon 88 and substrate and then downwards about the pivot bracket shaft and axis A so that the print head 14 may settle in on the ribbon and substrate with the alignment mechanism 12. Furthermore, the alignment mechanism 12 also facilitates movement of the print head 14 while printing, such that the print head may be continuously adjusting itself about the y-axis (i.e., roll) to ensure that there is uniform pressure applied across the ribbon 88 and substrate.

There are many advantages associated with the present invention. For instance, the design of the floating print head assembly 11 with the head bracket 16 and pivot bracket 18 allows the print head 14 force to be disassociated with the latch 50 force. Thus, to change ribbon 88, the latch button 48 only needs to be depressed to release the head bracket 16 from the pivot bracket 18, while the relatively stronger print head 14 force remains engaged through the ball joint shaft 56 and pivot bracket through axis B.

Furthermore, the alignment mechanism 12 permits the print head 14 to self-adjust about a y-axis (i.e., roll) to ensure that uniform pressure is applied across the substrate. Applying uniform pressure ensures that there will be uniform thermal transfer from the print head 14 to the ribbon 88 and substrate to produce a consistent quality image. Moreover, given the inherent tolerances associated with each of the components of the floating print head assembly 11, the alignment mechanism 12 allows for tolerances without sacrificing print quality. Finally, the floating print head assembly 11 and alignment mechanism 12 may be easily assembled and disassembled.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A print head assembly capable of applying substantially uniform pressure on a printing substrate comprising:

a print head bracket;

a print head attached to said bracket such that said bracket is operable to carry said print head from an open position suspended above the printing substrate to a closed position adjacent to the printing substrate;

an alignment mechanism disposed within said bracket, said print head bracket operable to pivot about said alignment mechanism about a first axis between the open position and the closed position, said print head bracket further operable to pivot about said alignment mechanism about a second axis such that said print head is capable of pivoting about the second axis to apply substantially uniform print pressure across the printing substrate in the closed position; and a pivot bracket, wherein said alignment mechanism is coupled to said pivot bracket along the first axis.

2. The print head assembly according to claim 1, wherein said alignment mechanism comprises a ball joint shaft and a ball joint cap, and wherein the cap is capable of pivoting about the ball joint shaft.

3. The print head assembly according to claim 2, wherein the ball joint shaft comprises a ball and the ball joint cap comprises a socket, and wherein the socket is capable of receiving the ball.

4. The print head assembly according to claim 1, wherein the second axis corresponds to a roll axis.

5. The print head assembly according to claim 1, wherein the first axis corresponds to a pitch axis.

6. The print head assembly according to claim 1, wherein said print head is capable of pivoting up to approximately 10 degrees about the second axis.

7. The print head assembly according to claim 1, further comprising a latch operable to engage said pivot bracket in the closed position and to disengage a pivot slot defined in said pivot bracket.

8. The print head assembly according to claim 7, wherein said latch is disposed within said print head bracket and is capable of pivoting about the second axis while engaging the pivot slot in the closed position.

9. A print head assembly capable of applying substantially uniform pressure on a printing substrate comprising:

a print head bracket;

a print head attached to said print head bracket such that said print head bracket is operable to carry said print head from an open position suspended above the printing substrate to a closed position adjacent to the printing substrate;

a pivot bracket coupled to said print head bracket, said print head bracket operable to pivot about said pivot bracket about a first axis between the open position and the closed position, said pivot bracket further operable to apply a print head force along the first axis; and a latch operable to engage said pivot bracket and secure said print head bracket in the closed position, wherein a latch force required to release said print head bracket from the closed position is disassociated with the print head force.

10. The print head assembly according to claim 9, further comprising an alignment mechanism disposed within said print head bracket, said print head bracket operable to pivot about said alignment mechanism about a second axis such that said print head is capable of pivoting about the second axis to apply substantially uniform print pressure across the printing substrate in the closed position.

11. The print head assembly according to claim 10, wherein the second axis corresponds to a roll axis.

12. The print head assembly according to claim 10, wherein the first axis corresponds to a pitch axis.

13. The print head assembly according to claim 10, wherein said print head bracket is operable to pivot about said pivot bracket about a third axis.

14. The print head assembly according to claim 13, wherein the third axis corresponds to a pitch axis.

15. A print head assembly capable of applying substantially uniform pressure on a printing substrate comprising:

a print head bracket;

a print head attached to said bracket such that said bracket is operable to carry said print head from an open position suspended above the printing substrate to a closed position adjacent to the printing substrate; and an alignment mechanism disposed within said bracket, said print head bracket operable to pivot about said alignment mechanism about a first axis between the open position and the closed position, said print head bracket further operable to pivot about said alignment mechanism about a second axis such that said print head is capable of pivoting about the second axis to apply substantially uniform print pressure across the printing substrate in the closed position, wherein said alignment mechanism comprises a ball joint shaft and a ball joint cap, and wherein the cap is capable of pivoting about the ball joint shaft.

16. The print head assembly according to claim 15, wherein the ball joint shaft comprises a ball and the ball joint cap comprises a socket, and wherein the socket is capable of receiving the ball.

17. The print head assembly according to claim 15, wherein the second axis corresponds to a roll axis.

18. The print head assembly according to claim 15, wherein the first axis corresponds to a pitch axis.

19. The print head assembly according to claim 15, wherein said print head is capable of pivoting up to approximately 10 degrees about the second axis.

* * * * *